United States Patent [19]

Dirksing

[11] 4,208,747

[45] Jun. 24, 1980

[54] PASSIVE DOSING DISPENSER EMPLOYING TRAPPED AIR BUBBLE TO PROVIDE AIR-LOCK

[75] Inventor: Robert S. Dirksing, Cincinnati, Ohio

[73] Assignee: The Procter & Gamble Company, Cincinnati, Ohio

[21] Appl. No.: 2,524

[22] Filed: Jan. 11, 1979

Related U.S. Application Data

[63] Continuation-in-part of Ser. No. 897,469, Apr. 18, 1978, abandoned.

[51] Int. Cl.[2] ..... E03D 9/02; E03D 9/03

[52] U.S. Cl. ..... 4/228; 4/227; 222/416; 222/541

[58] Field of Search ..... 4/227, 228, 231, 226, 4/223, 225; 222/416, 541

[56] References Cited

U.S. PATENT DOCUMENTS

| | | | |
|---|---|---|---|
| 650,161 | 5/1900 | Williams et al. | 4/228 |
| 1,175,032 | 3/1916 | Williams | 4/228 |
| 3,407,412 | 10/1968 | Spear | 4/228 |
| 3,444,566 | 5/1969 | Spear | 4/228 |
| 3,769,640 | 11/1973 | Castronovo | 4/228 |
| 3,772,715 | 11/1973 | Nigro | 4/228 |
| 3,778,849 | 12/1973 | Foley | 4/228 |
| 3,781,926 | 1/1974 | Levey | 4/228 |
| 3,831,205 | 8/1974 | Foley | 4/228 |
| 3,934,279 | 1/1976 | Mallin | 4/228 |
| 3,943,582 | 3/1976 | Daeninckx et al. | 4/227 |
| 3,952,339 | 4/1976 | Baur et al. | 4/228 |
| 4,064,572 | 12/1977 | Wicks | 4/228 |

*Primary Examiner*—Henry K. Artis

*Attorney, Agent, or Firm*—E. Kelly Linman; John V. Gorman; Richard C. Witte

[57] ABSTRACT

A passive dosing dispenser for issuing, for example, a predetermined volume of a toilet tank additive solution into a toilet tank as the water is draining therefrom while the toilet is flushing. A preferred dispenser comprises a product chamber for containing a quantity of a solid type product which can be dissolved in water to form a toilet tank additive product solution, a reservoir for containing a quantity of said solution in fluid communication with said product chamber, an inlet/discharge conduit having its lowermost end in fluid communication with said reservoir and its uppermost end in fluid communication with a syphon tube, an air trap disposed adjacent said inlet/discharge conduit for isolating said product solution from the toilet tank water in said syphon tube during quiescent periods, and an air vent in fluid communication with said reservoir and product chamber. In operation, while the water in the toilet tank is receding from about the dispenser, a predetermined quantity of said product solution is syphoned from said reservoir through the inlet/discharge conduit and is dispensed through the syphon tube. In a particularly preferred embodiment, the dispenser provides a pair of air-locks when completely immersed in a full toilet tank which air-locks isolate the product and product solution from toilet tank water which surrounds the dispenser during quiescent periods.

21 Claims, 18 Drawing Figures

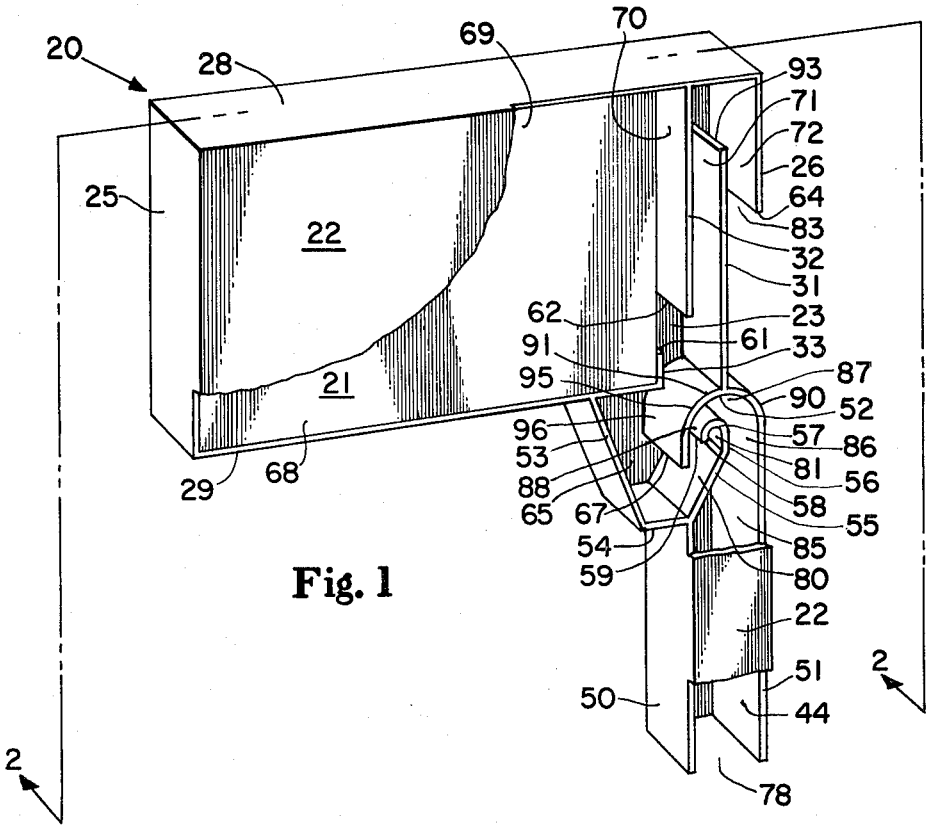
Fig. 1
Fig. 2
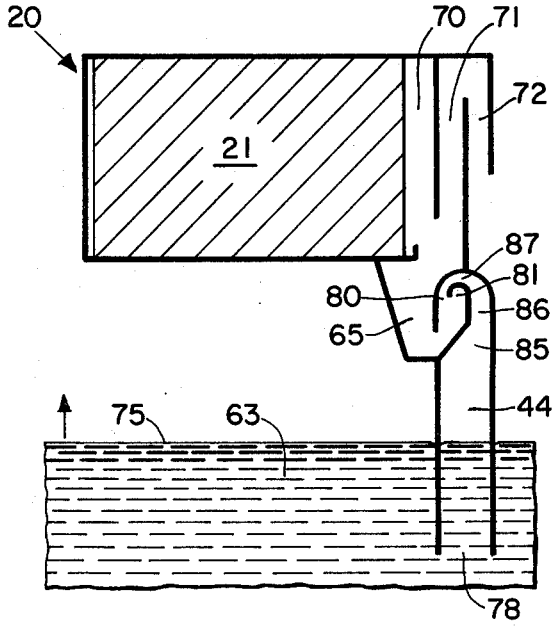
Fig. 3
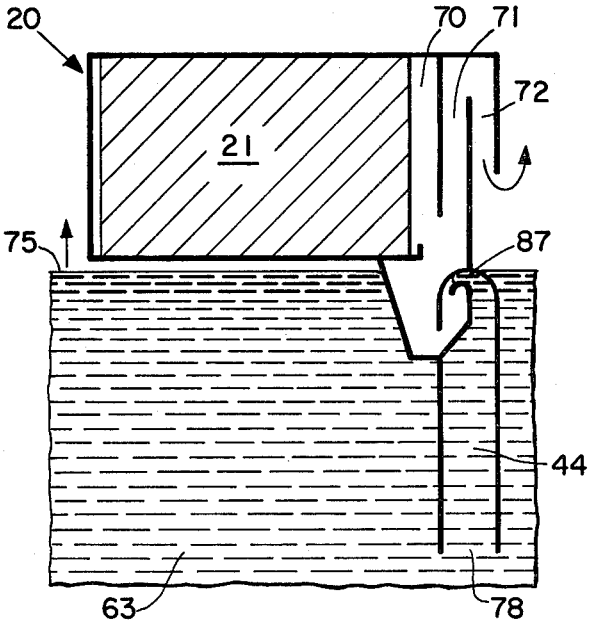

PASSIVE DOSING DISPENSER EMPLOYING TRAPPED AIR BUBBLE TO PROVIDE AIR-LOCK

CROSS-REFERENCE TO RELATED APPLICATION

This application is a continuation-in-part of co-pending application Ser. No. 897,469, filed Apr. 18, 1978 in the name of the present applicant and now abandoned.

FIELD OF THE INVENTION

The present invention pertains, in general, to providing a dosing type dispenser for such products as toilet tank additives: for instance, disinfectants. More specifically, the present invention provides an entirely passive (no moving parts) dispenser in which a solid type product will gradually be dissolved to form a solution, and from which dispenser such solution will be incrementally issued: a predetermined quantity or dose-volume of solution being issued each time the water in the toilet tank recedes from around the dispenser. Dispenser embodiments of the present invention also provide means for make-up water to enter the dispenser, and air-lock isolation of the product and product solution from surrounding toilet tank water during quiescent periods. Plural product dispenser embodiments are also provided which can, because each segment provides product and product solution isolation from the toilet tank water during quiescent periods, co-dispense solutions of two or more products which should not be mixed before their intended use.

BACKGROUND OF THE INVENTION

Passive dosing dispensers of various geometries are disclosed in prior art patents. For instance, U.S. Pat. No. 650,161 which issued to J. Williams et al. on May 22, 1900 and U.S. Pat. No. 1,175,032 which issued to E. R. Williams on Mar. 14, 1916 disclose passive dispensers which are alternately flooded and then syphoned to a predetermined level. Also, U.S. Pat. No. 3,772,715 which issued to L. V. Nigro on Nov. 20, 1973, and U.S. Pat. No. 3,781,926 which issued to J. Levey on Jan. 1, 1974, and U.S. Pat. No. 3,943,582 which issued to J. Daeninckx et al. on Mar. 16, 1976 disclose passive dispensers which are alternately flooded and then gravitationally drained. Moreover, U.S. Pat. No. 3,407,412 which issued to C. T. Spear on Oct. 29, 1968, and U.S. Pat. No. 3,444,566 which issued to C. T. Spear on May 20, 1969 disclose dispensers which, although they have no moving parts, must be connected to a pressurized water supply such as the trap refill tube in a toilet tank and in which the direction of flow alternates in labyrinth passages. However, none of the discovered prior art discloses a passive dosing dispenser for the purpose described which has solved all of the problems associated with such dispensing in the manner of or to the degree provided by the present invention; particularly the problem of providing product and product solution isolation from surrounding water during quiescent periods.

SUMMARY OF THE INVENTION

In accordance with one aspect of the invention, a dispenser is provided which comprises an internal product chamber for containing a quantity of a solid product in fluid communication with a reservoir for containing a quantity of product solution, and means for causing a predetermined quantity or dose-volume of said solution to be conducted from said reservoir and issue from the dispenser in response to the level of a body of the liquid being lowered from a first elevation to a second elevation. Such a dispenser can comprise a product chamber, a reservoir in fluid communication with said product chamber, a syphon tube extending downwardly from said reservoir and having an open lower end, an inlet/-discharge conduit having an air trap disposed adjacent thereto, said conduit having its lowermost end in fluid communication with said reservoir and its uppermost end in fluid communication with the uppermost end of said syphon tube, and an air vent in fluid communication with said reservoir and product chamber.

The air trap disposed adjacent the inlet/discharge conduit acts to retain an air bubble when water enters the product solution reservoir via the syphon tube and inlet/discharge conduit as the water level in the toilet tank returns to the FULL level. As long as water is flowing inwardly through the inlet/discharge conduit the air bubble is retained in the trap. However, when the air vent in fluid communication with the reservoir is blocked by the rising water level in the toilet tank and forms an air-lock between the solution within the reservoir and the toilet tank water or when the water level in the toilet tank ceases to rise in the event this occurs prior to blockage of the air vent, the inward flow of water through the syphon tube and inlet/discharge conduit ceases, and, due to the geometry of the inlet/-discharge conduit, the air trap, and the connecting passageway joining the syphon tube and the inlet/discharge conduit, the trapped air bubble relocates itself into the headspace joining the upper reaches of the inlet/discharge conduit and the syphon tube, thereby isolating the toilet tank water in the syphon tube from the product solution contained in the product solution reservoir and the inlet/discharge conduit until the next flush cycle. As a result the product and product solution are completely isolated from the surrounding toilet tank water during quiescent periods intermediate flush cycles.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

FIG. 1 is a partially torn away perspective view of a passive dosing dispenser which is an embodiment of the present invention;

FIGS. 2, 3, 5, 7 and 8 are simplified, sequential sectional views which show a portion of a cycle of the dispenser shown in FIG. 1 and which views are taken along section line 2—2 of FIG. 1;

DESCRIPTION OF THE PREFERRED EMBODIMENTS

Figure 4:
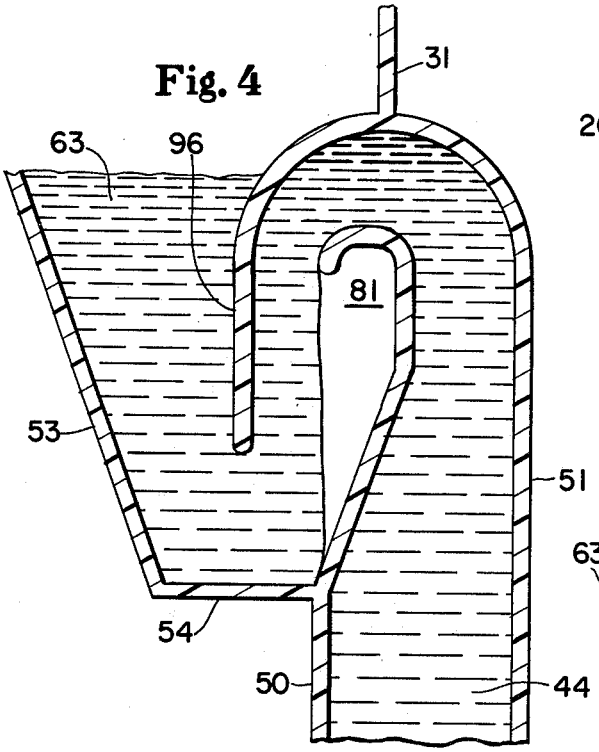
FIG. 4 is an enlarged fragmentary sectional view of the air trap portion of the dispenser of FIG. 1 in the condition illustrated in FIG. 3.
Figure 5:
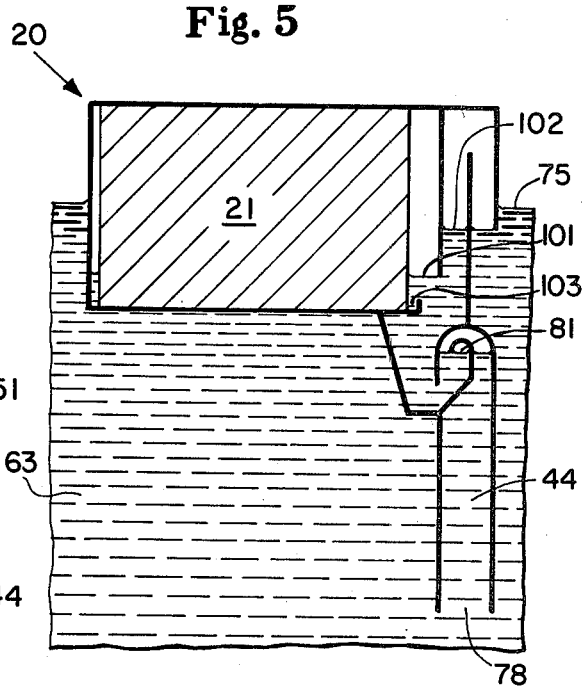
Figure 6:
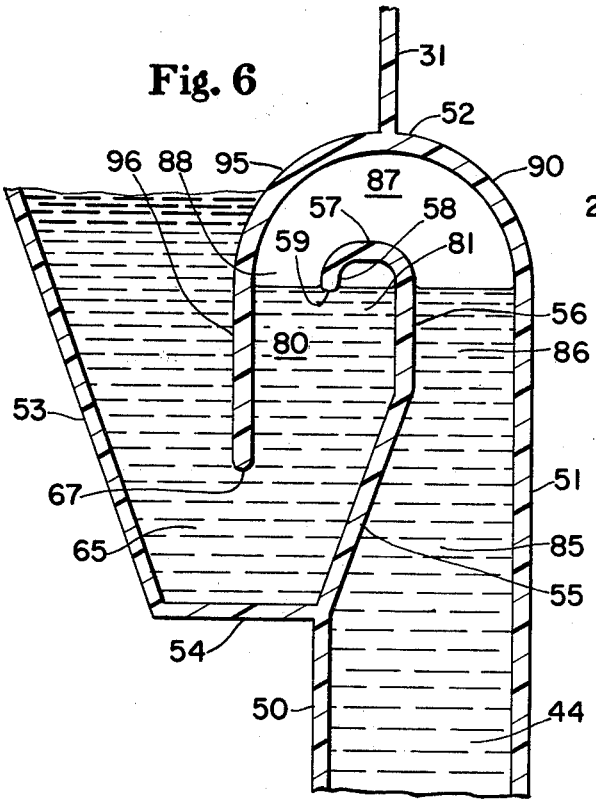
FIG. 6 is an enlarged fragmentary sectional view of the air trap portion of the dispenser of FIG. 1 in the condition illustrated in FIG. 5.

Referring now to the figures in which identical features are identically designated, FIG. 1 shows a dispenser 20 embodying the present invention and containing a solid, water soluble product 21. Dispenser 20 comprises a front wall 22, a back wall 23, sidewall segments 25, 26, 31, 50, 51, 52 and 90, a top wall 28, bottom wall segments 29, 53 and 54, and interior partitions 32, 33, 55, 56, 57, 58, 91, 95 and 96. The walls and partitions are rigid and define a primary product reservoir 65, a secondary product reservoir 68, a solid product chamber 69, a syphon tube 44 having uppermost vertical passageways 85 and 86, a horizontal passageway 87, a vertical passageway 88 connecting with inlet/discharge conduit 80, said inlet/discharge conduit having an air trap 81 disposed adjacent thereto, and vent means for the product chamber comprising passageways 71 and 72 and air vent 83. In the case of dispenser 20, primary product reservoir 65 an product chamber 69, including secondary product reservoir 68, where utilized, together comprise what is collectively referred to as an internal reservoir. The lowermost edge of partition segment 58 is designated 59, the lowermost edge of partition segment 96 is designated 67, the uppermost edge of partition segment 33 is designated 61, the lowermost edge of level control partition 32 is designated 62, the uppermost edge of sidewall segment 31 is designated 93, and the lowermost edge of sidewall segment 26, which in conjunction with front and back walls 22 and 23 respectively and sidewall segment 31 define air vent 83, is designated 64. The inlet/discharge port of dispenser 20 located at the lowermost end of syphon tube 44 is designated 78.

Briefly, referring to FIG. 2, a dispenser 20 containing solid product 21 is disposed, for instance, in a toilet tank (not shown) on a bracket or other mounting means (not shown) so that the FULL level of water 63 in the toilet tank is sufficiently high to at least reach edge 64 of sidewall segment 26, the dispenser will respond as shown in FIGS. 2–8 as the level of water rises to the FULL position in the toilet tank and the toilet is thereafter flushed.

The dispenser 20 illustrated in FIG. 2 is shown prior to immersion in the toilet tank water 63. As the toilet tank water 63 rises, it enters syphon tube 44 through inlet/discharge port 78. Air within the upper reaches of the syphon tube is allowed to vent through vertical passageways 85 and 86, horizontal passageway 87, vertical passageway 88, inlet/discharge conduit 80, primary solution reservoir 65, vent passageways 71 and 72 and air vent 83. As the level of the toilet tank water 63 continues to rise, FIG. 3, it begins to enter horizontal passageway 87. Because the difference in elevation of the water in the toilet tank and the water within the syphon tube is relatively small prior to air vent 83 becoming blocked, the water head or water pressure available to force the water in syphon tube 44 around the loop through vertical passageway 88 and into inlet/discharge conduit 80 is likewise quite small. To minimize the required driving force to initiate water flow through the loop, the dispenser 20 preferably employs a series of passageways 85, 86, 87 and 88, each of which is smaller in cross-section than any portion of the one immediately preceding it, thereby providing capillary suction in the direction of flow which tends to draw the water from the syphon tube 44 into the inlet/discharge conduit 80. This feature is more clearly illustrated in the enlarged fragmentary view of FIG. 4. It is of course recognized that a maximum degree of capillary suction may be provided by employing passageways 86, 87 and 88 having characteristics similar to passageway 85 which exhibits a continual reduction in cross-section in the direction of liquid flow during the dispenser charging operation. If desired, the entire length of the syphon tube 44 may be convergent in the direction of water flow during the charging operation.

Once toilet tank water 63 enters inlet/discharge conduit 80 and begins to collect in primary solution reservoir 65, the condition illustrated in FIG. 4 prevails in the air trap 81 disposed adjacent inlet/discharge conduit 80. Namely, an air bubble is retained within the confines of the air trap 81 defined by partition segments 55, 56, 57 and 58. The condition illustrated in FIG. 4 persists as long as toilet tank water 63 continues to enter the dispenser 20.

When the level 101 of solution 103 formed by dissolution of solid product 21 in the incoming water within dispenser product chamber 69 reaches lowermost edge 62 of level control partition 32, an air-lock is formed in the uppermost reaches of the product chamber 69, thereby preventing the solution level 101 from rising further within the product chamber. It should be noted, however, that the solution level 102 in passageway 71 continues to rise until such time as the toilet tank water 63 contacts lowermost edge 64 of sidewall segment 26 and blocks air vent 83, thus providing a secondary air-lock in the uppermost reaches of passageway 71 and passageway 72. This secondary air-lock isolates the product solution 103 formed by dissolution of the solid product 21 in the toilet tank water introduced during the charging cycle and the toilet tank water blocking air vent 83. As is apparent from FIG. 5, the level 102 of product solution 103 within dispenser passageway 71 is identical to the level of toilet tank water 63 in passageway 72. While the level 102 of product solution 103 in passageway 71 is distinct from the level 101 of the product solution within product chamber 69 due to the presence of level control partition 32 in the illustrated embodiment, it should be noted that level control partition 32 could be eliminated from the dispenser 20 without adversely affecting the basic functioning thereof. However, the level of product solution within the product chamber 69 would then be controlled exclusively by the vertical location of air vent 83, assuming the FULL level of the toilet tank is above the air vent.

In the event the FULL level of the toilet tank is below the air vent 83, the level 102 of solution 103 in passageway 71 will be identical to the level 75 of toilet tank water 63 surrounding the dispenser, while the level 101 of solution 103 within product chamber 69 will be controlled by lowermost edge 62 of level control partition 32.

In the event level control partition 32 is eliminated and the FULL level of the toilet tank is below the air vent 83, the level of solution 103 within the dispenser 20 will be identical to the level 75 of toilet tank water 63 surrounding the dispenser 20. In all cases, dispenser embodiment 20 will function to isolate product solution 103 contained in the upper reaches of product chamber 69 from the surrounding toilet tank water 63 whether or not air vent 83 is blocked by toilet tank water. In the event air vent 83 is blocked by tank water, isolation is provided by means of an air-lock created in the upper reaches of passageway 72. In the event air vent 83 is not blocked by tank water, the vent to atmosphere provides the desired isolation from the toilet tank water.

Figure 17:
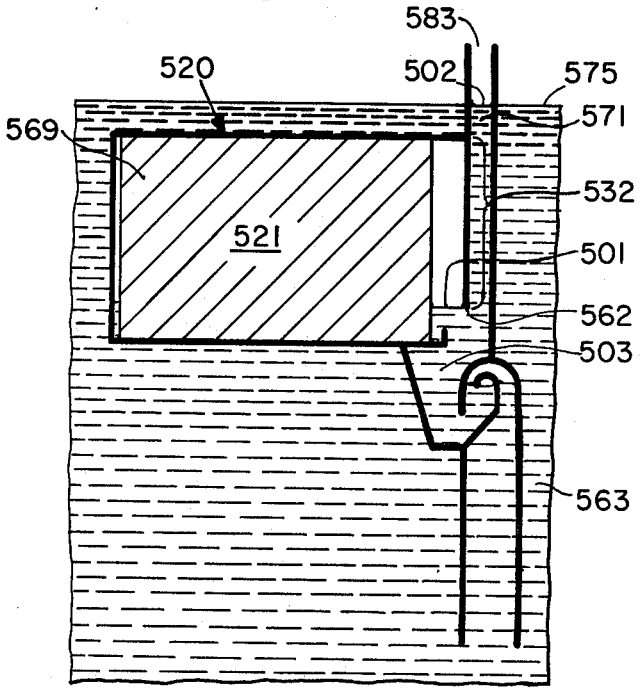
FIG. 17 is a simplified schematic illustration of another embodiment of the present invention shown after the water has reached its FULL level in the toilet tank.
Figure 18:
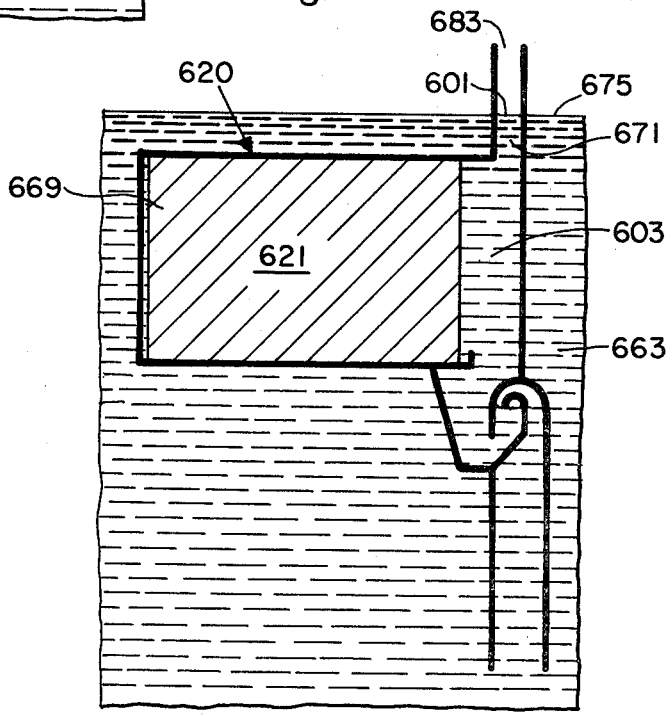
FIG. 18 is a simplified schematic illustration of still another embodiment of the present invention shown after the water has reached its FULL level in the toilet tank.

By way of contrast, dispenser embodiments 520 and 620 of the present invention illustrated in FIGS. 17 and 18 must be so positioned in the toilet tank that the air vents 583 and 683, respectively, remain vented to atmosphere at all times, i.e., the air vents must be maintained above the FULL level of the toilet tank to ensure isolation of the solution contained within the dispensers from the surrounding toilet tank water.

The dispenser embodiment 520 illustrated in FIG. 17 is, with the exception of reconstruction and relocation of air vent 583, similar to dispenser embodiment 20. However, passageway 72 has been eliminated from dispenser 20 and passageway 71 has been vertically extended beyond top wall 28 of dispenser 20 to form a single vertical passageway 571 in dispenser embodiment 520. Lowermost edge 562 of level control partition 532, which corresponds to lowermost edge 62 of level control partition 32 in dispenser 20, fixes the level 501 of product solution 503 formed by dissolution of solid product 521 within product chamber 569, while the level 502 of product solution 503 in passageway 571 is identical to the level 575 of the surrounding toilet tank water 563. As will be apparent from an inspection of FIG. 17, air vent 583 must at all times be maintained above the FULL level 575 of the toilet tank water 563 to ensure isolation of the product solution from the tank water. This is so because, unlike dispenser embodiment 20, vertical passageway 571 has no provision for forming an air-lock if the dispenser air vent 583 is immersed.

The dispenser embodiment 620 illustrated in FIG. 18 is, with the exception of elimination of level control partition 532 from dispenser embodiment 520, identical thereto. In the latter situation, the entire product chamber 669 is flooded when the level 675 of toilet tank water 663 is FULL. The level 601 in passageway 671 of product solution 603 formed by dissolution of solid product 621 is identical to the level 675 of the surrounding toilet tank water 663. As with dispenser embodiment 520, air vent 683 must at all times be maintained above the FULL level 675 of the toilet tank water 663 to ensure isolation of the product solution 603 from the tank water.

Referring again to FIG. 5, which represents the condition of the dispenser 20 when the toilet tank water level 75 has reached its FULL position, the bulk of the air bubble retained within air trap 81 during the charging operation has rotated about edge 59 of partition segment 58 so as to substantially fill horizontal passageway 87 as well as the uppermost portions of vertical passageways 86 and 88, thereby isolating the product solution 103 contained within the inlet/discharge conduit 80 from the toilet tank water 63 contained within passageway 86 of syphon tube 44. This feature is more clearly illustrated in FIG. 6 which is an enlarged fragmentary view of the air trap portion of the dispenser 20 illustrated in FIG. 5. It is thus clear that the product solution 103 contained within passageway 71, product chamber 69, primary reservoir 65 and inlet/discharge conduit 80 is completely isolated from toilet tank water 63 by means of the air-lock provided in the uppermost sections of passageways 71 and 72 and the air-lock provided in the uppermost sections of passageways 86, 88 and horizontal passageway 87. As will be appreciated by those skilled in the art, the toilet tank water brought into contact with solid product 21 during the charging cycle will continue to dissolve the solid product until such time as the product solution 103 becomes saturated or until such time as the toilet is flushed and a predetermined quantity or dose-volume of the solution is dispensed. As will also be appreciated by those skilled in the art, the exterior surfaces of solid product 21 are preferably so configured as to permit a uniform degree of surface exposure to the solution 103 along the entire length and width of the solid product. To this end, the exterior surfaces of the solid product may be longitudinally grooved, etc. Uniform surface exposure of the solid product 21 to the solution 103 promotes more uniform erosion of the solid product, and thereby more uniform setting of the solid product into secondary solution reservoir 68.

Figure 7:
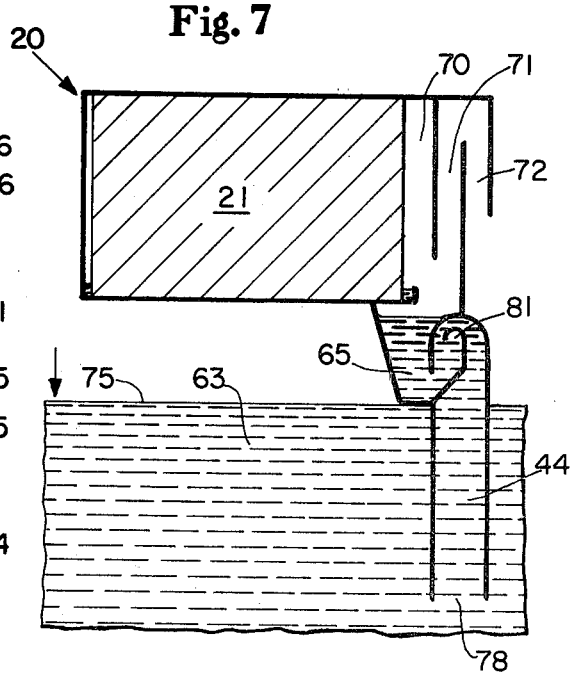

FIG. 7 represents the condition of the dispenser when the toilet is flushed and the tank water level drops, thereby exposing air vent 83 and forming a partial vacuum in the syphon tube 44. Product solution 103 is drawn from the primary reservoir 65 into syphon tube 44. Transfer of solution 103 from the primary reservoir 65 continues until such time as the solution level reaches edge 67 of partition segment 96, FIG. 8, thereby venting syphon tube 44 and releasing the product solution retained therein into the toilet tank water.

Figure 8:
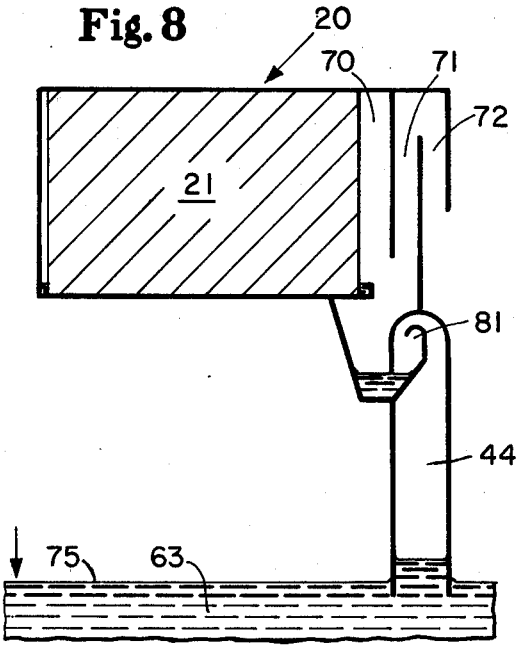

As is also apparent from FIG. 8, uppermost edge 61 of partition segment 33 retains a portion of the concentrated product solution 103 within secondary reservoir 68 after the dispensing cycle has been completed. The solution thus retained will be available to cover rapid multiple flushes of the toilet. In addition, the secondary reservoir 68 serves to prevent the collection of a thick concentrate of solution 103 in the lowermost portions of primary solution reservoir 65. When the level 75 of the toilet tank water 63 returns to the FULL position illustrated in FIG. 5, the dispenser 20 will likewise be restored to the condition illustrated in FIG. 5, and will remain in that condition during the ensuing quiescent period awaiting the next flush cycle of the toilet.

The dispenser embodiment 20 illustrated in FIG. 1 will discharge a predetermined quantity or dose-volume of product solution 103 from the dispenser each time the toilet is flushed. The dose-volume of solution is substantially equal to the quantity of solution contained within dispenser 20 between lowermost edge 62 of level control partition 32 and lowermost edge 67 of partition segment 96 in addition to the column of product solution contained within passageway 71, but exclusive of the quantity of solution retained within secondary solution reservoir 68. The quantity of product solution 103 retained in secondary reservoir 68 is in turn determined by the vertical location of edge 61 of partition segment 33. The amount of product solution 103 dispensed during each flush cycle is more easily understood by comparing FIG. 5 which illustrates the condition of the dispenser 20 when the toilet tank water level 75 is FULL and air vent 83 has been blocked by the water with FIG. 8 which illustrates the condition of the dispenser when the solution level within primary solution reservoir 65 has reached lowermost edge 67 of partition segment 96 and the dose-volume of solution within syphon tube 44 has been released.

As has been pointed out earlier herein, the solid, water soluble product 21 contained in product chamber 69 will dissolve in the water introduced during each flush cycle to form product solution 103 until such time as the solution becomes saturated or the toilet is again flushed. As the lower portions of the solid product 21 are consumed by exposure to the liquid, the solid product will settle due to gravity into the secondary reservoir 68 contained within product chamber 69. Because the volume and exposed surface area of solid product 21 below edge 62 of level control partition 32 remain essentially constant throughout the life of the solid product, the strength or concentration of the solution 103 remains essentially constant throughout the life of the dispenser 20, assuming an adequately long quiescent period for the solution to become saturated is provided intermediate flush cycles. This condition will prevail at least until such time as the overall height of the solid product 21 becomes less than the vertical distance between lowermost edge 62 of level control partition 32 and bottom wall segment 29 of the dispenser.

While the dispenser embodiment illustrated in FIG. 1 incorporates a preferred air trap 81 disposed adjacent the inlet/discharge conduit 80, the air trap utilized to retain an air bubble during the water charging operation may take many different forms. For example, a sudden expansion in cross-sectional flow area could be provided in vertical inlet passageway 88 followed immediately by a sudden contraction in flow area such that fluid entering the primary reservoir 65 through the inlet/discharge conduit 80 is unable to exert sufficient force on the air bubble trapped within the expanded flow area to expel it through the primary reservoir 65 and out the air vent 83. Alternatively, the air trap could take the form of a partial obstruction in inlet/discharge conduit 80, which partial obstruction prevents fluid passing through the conduit from exerting sufficient force on the air bubble retained within the trap from being expelled through the primary reservoir 65 and out the air vent 83. It is necessary only that the air trap be of sufficient volume and so located that upon cessation of the flow of water past the air trap the air bubble contained therein will attempt to rise into the uppermost reaches of the chamber connecting the syphon tube and the inlet/discharge conduit so as to completely isolate the toilet tank water 63 in the syphon tube from the product solution 103 contained in the inlet/discharge conduit.

Figure 15:
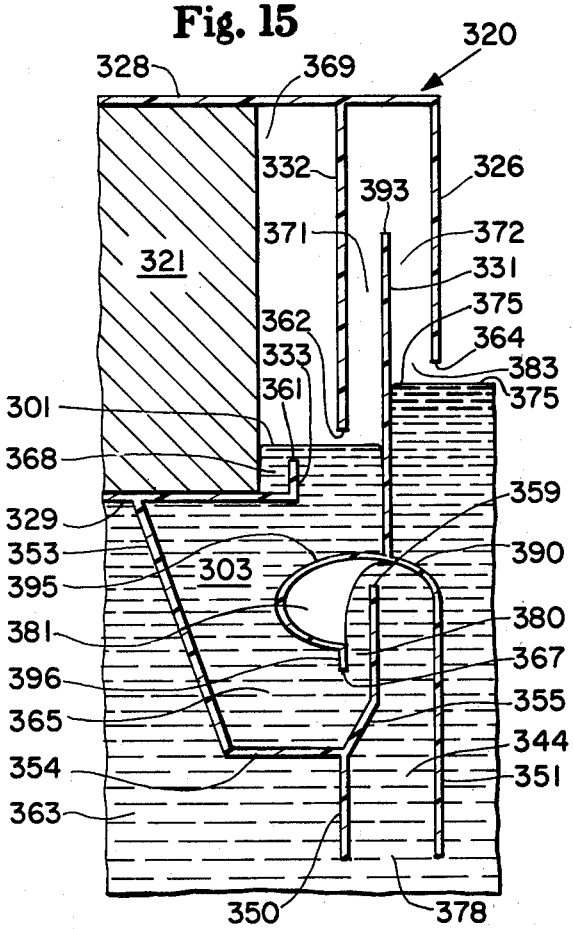
FIG. 15 is a fragmentary sectional view of yet another embodiment of a passive dosing dispenser of the present invention shown as the water level is rising in the toilet tank.

FIG. 15 is a fragmentary sectional view of an alternative embodiment of a dispenser 320 of the present invention shown during the water charging operation as the level 375 of water 363 in the toilet tank is rising. The dispenser 320 is basically similar to the dispenser 20 illustrated in FIG. 1. The illustrated portions of dispenser 320 comprise top wall 328, bottom wall segments 329, 353, 354, and 355, sidewall segments 326, 331, 350 and 351, interior level control partition 332, interior partition 395 forming air trap 381 and interior partition segment 396 which in conjunction with the uppermost portion of wall segment 350 forms inlet/discharge conduit 380. As with the embodiment of FIG. 1, a solid, water soluble product 321 is disposed within product chamber 369 such that its lowermost surface rests within secondary solution reservoir 368 defined by interior partition segment 333 having uppermost edge 361. The lowermost edge of level control partition 332 is designated 362, the uppermost edge of wall segment 331 is designated 393, the lowermost edge of sidewall segment 326 is designated 364, the uppermost edge of sidewall segment 350 is designated 359 and the lowermost edge of partition segment 396 is designated 367. Product chamber 369 and primary solution reservoir 365 are initially vented by means of passageways 371 and 372 and air vent 383 defined by edge 364 of sidewall segment 326, the front and back wall portions (not shown) of dispenser 320 and sidewall segment 331. In the case of dispenser 320, primary solution reservoir 365 and product chamber 369, including secondary solution reservoir 368, where utilized, together comprise what is collectively referred to as an internal reservoir. Syphon tube 344 is defined by sidewall segments 350, 351 and 390 as well as the corresponding front and back wall portions (not shown) of dispenser 320. The inlet/discharge port located at the lowermost end of syphon tube 344 is designated 378. As with the embodiment illustrated in FIG. 1, the uppermost portions of the syphon tube are convergent, i.e., the radial distance from uppermost edge 359 of sidewall segment 350 to sidewall segment 390 and to interior partition 395 continually decreases in the direction of liquid flow, at least until the point of vertical alignment with sidewall segment 350. The air trap 381 formed by interior partition 395 is located adjacent the entrance to inlet/discharge conduit 380.

Figure 16:
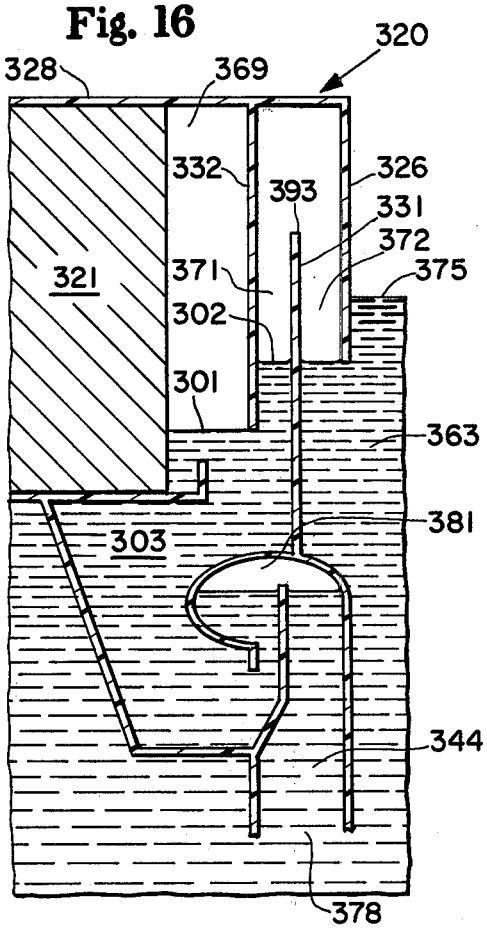
FIG. 16 is a fragmentary sectional view of the dispenser of FIG. 15 shown after the water has reached its FULL level in the toilet tank.

In the condition illustrated in FIG. 15, the toilet tank water 363 has risen sufficiently in syphon tube 344 to trap an air bubble within air trap 381 as it proceeds to fill primary solution reservoir 365 and the lowermost portions of product chamber 369. As long as the water continues to flow within the syphon tube and inlet/discharge conduit, the trapped air bubble will remain within the confines of the air trap 381. When, however, air vent 383 is blocked by the rising toilet tank water 363 as shown in FIG. 16, fluid flow in the inlet/discharge conduit 380 ceases, and the trapped air bubble rises, thereby providing air-lock isolation of the product solution 303 and the toilet tank water 363 on opposite sides of edge 359 of sidewall segment 350. The product solution 303 at level 302 within passageway 371 is likewise isolated from the toilet tank water by means of the air-lock contained in the uppermost reaches of passageways 371 and 372. The level 301 of product solution 303 within dispenser 320 is defined by lowermost edge 362 of level control partition 332 in a manner similar to that described in connection with embodiment 20 of FIG. 1. When the toilet is flushed, dispenser embodiment 320 reacts in a manner similar to embodiment 20 described in connection with FIG. 1. When the level of solution in primary reservoir 365 reaches lowermost edge 367 of partition segment 396, the column of liquid retained within syphon tube 344 is vented, thereby dispensing a predetermined quantity of product solution 303 into the toilet tank through inlet/discharge port 378.

Figure 9:
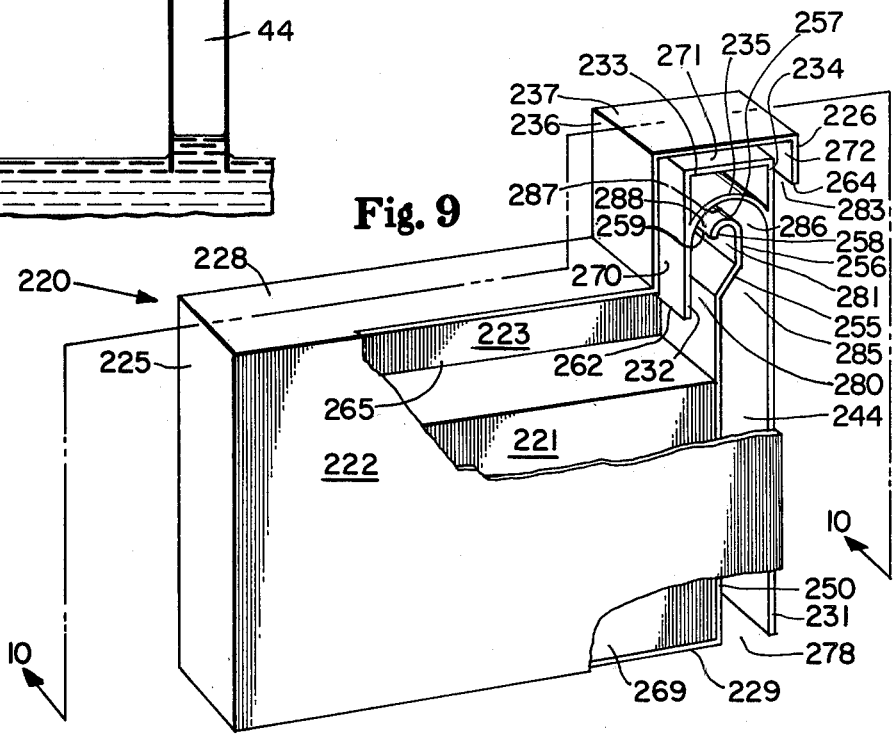
FIG. 9 is a partially torn away perspective view of another embodiment of a passive dosing dispenser of the present invention.

FIG. 9 illustrates yet another embodiment of a dispenser 220 of the present invention. Dispenser 220 is in many respects similar to dispenser embodiment 20 illustrated in FIG. 1. It comprises a front wall 222, a back wall 223, sidewall segments 225, 226, 231 and 236, top wall segments 228 and 237, bottom wall 229, interior partition segments 232, 233, 234, 235, 250, 255, 256, 257 and 258. The wall segments and partition segments are relatively rigid and define a syphon tube 244 having inlet/discharge port 278 at its lowermost end and sections 285 and 286 at its uppermost end, a horizontal passageway 287, a vertical passageway 288 connecting with inlet/discharge conduit 280, said inlet/discharge conduit having an air trap 281 disposed adjacent thereto in a manner similar to that of embodiment 20 illustrated in FIG. 1, a solid product chamber 269, a product solution reservoir 265 and vent passageways 270, 271 and 272 connecting said solid product chamber and said solution reservoir with air vent 283 which coincides with edge 264 of sidewall segment 226. In the case of dispenser 220, product solution reservoir 265 is coextensive with product chamber 269, said product solution reservoir and said product chamber together comprising what is collectively referred to as an internal reservoir. Lowermost edge of partition segment 232 is designated 262 and lowermost edge of partition segment 258 is designated 259. While a solid, water soluble product cake 221 is disposed within the lowermost portions of reservoir 265, it is not intended to thereby limit the present invention. As will be understood from the description contained herein, dispenser embodiments of the present invention may also be utilized to dispense a dose-volume of pre-mixed liquid product solution with each flush cycle of the toilet. In such embodiments, the solid, water soluble product cake is eliminated and the product chamber and solution reservoir are filled with either a pre-mixed liquid product solution or a water soluble powder which dissolves to form a liquid product solution upon immersion of the dispenser in the toilet tank.

Figure 10:
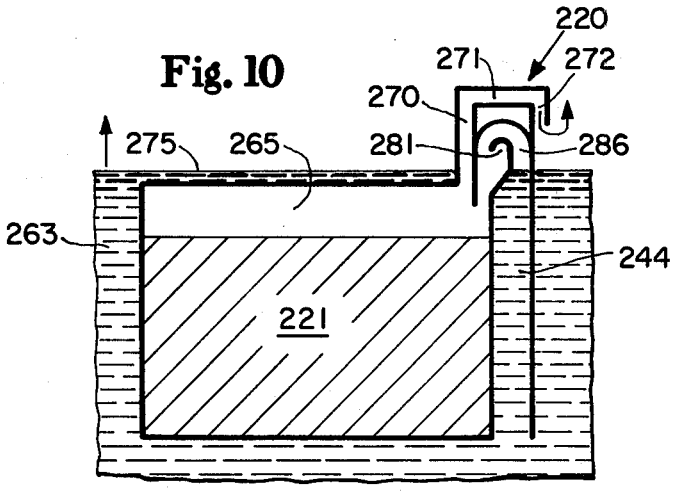
FIGS. 10–14 are simplified, sequential sectional views which show a portion of a cycle of the dispenser shown in FIG. 9 and which views are taken along section line 10—10 of FIG. 9.
Figure 11:
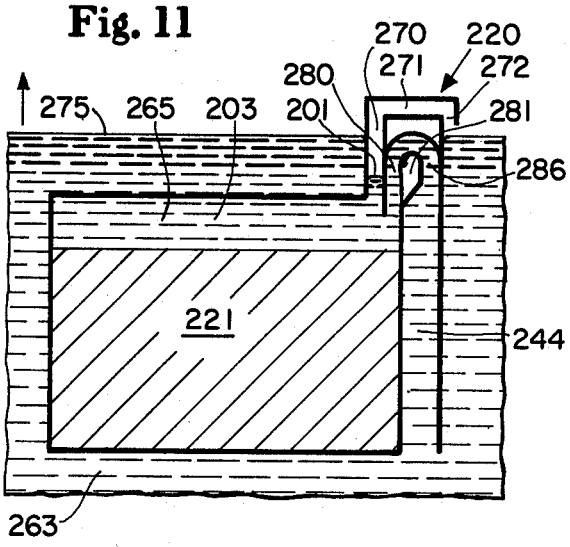
Figure 12:
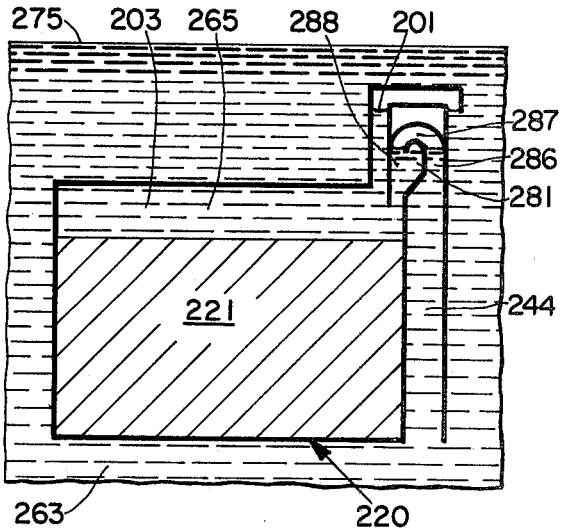

The principles of operation of dispenser 220 illustrated in FIG. 9 are, with the obvious exception of relocation of the solid product 221 to the lower position, generally the same as those described in connection with embodiment 20 of FIG. 1. As shown in FIG. 10, the water level 275 is rising in the toilet tank and in syphon tube 244. In the condition illustrated in FIG. 10, the dispenser 220 has not yet been completely immersed in the toilet tank. Consequently, solution reservoir 265 is at this point devoid of product solution. As toilet tank water 263 rises in syphon tube 244, air is vented through passageways 285, 286, 287 and 288, inlet/discharge conduit 280, solution reservoir 265 and passageways 270, 271 and 272 to air vent 283. As shown in FIG. 11, when water traverses horizontal passageway 287, vertical passageway 288 and enters reservoir 265 via inlet/discharge conduit 280, an air bubble is retained within air trap 281 in a manner similar to that described in connection with embodiment 20 of FIG. 1. Toilet tank water entering solution reservoir 265 begins to dissolve the solid product 221 to form an aqueous product solution 203. The level 201 of solution 203 continues to rise in passageway 270 until such time as the toilet tank water level blocks air vent 283, at which point water ceases to flow into dispenser 220 via syphon tube 244. FIG. 12 depicts the condition of dispenser 220 when the water in the toilet tank has reached the FULL level and the dispenser has been fully charged with toilet tank water to form product solution 203. When the water ceases to flow in horizontal passageway 287 and vertical passageway 288, the bulk of the air bubble retained in air trap 281 rises and in so doing rotates about edge 259 of partition segment 258 to form an air-lock in horizontal passageway 287 and the uppermost segments of vertical passageways 286 and 288, as shown in FIG. 12. The condition shown in FIG. 12 will persist during quiescent periods intermediate flush cycles of the toilet.

Figure 13:
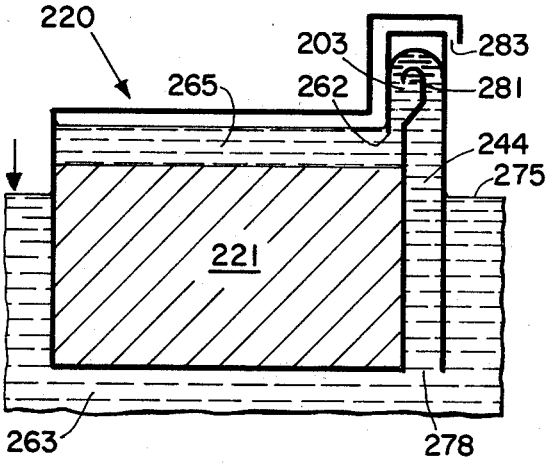
Figure 14:
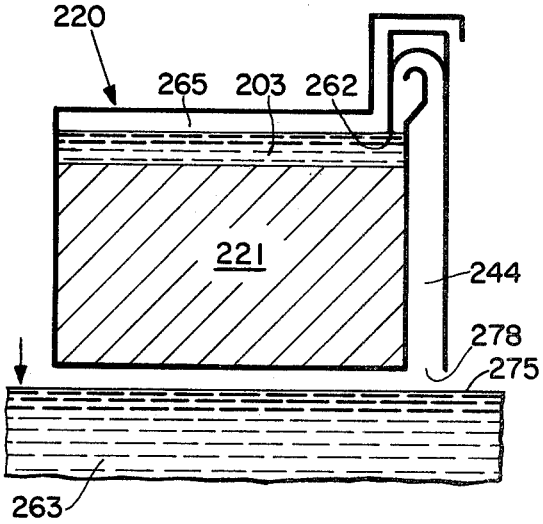

When the toilet is flushed, FIG. 13, water in the toilet tank will fall below air vent 283 of dispenser 220. This provides an air supply so that syphoning of the product solution 203 from reservoir 265 may occur. As shown in FIG. 13, air trap 281 is filled with product solution 203 as the syphoning action from the reservoir 265 to syphon tube 244 takes place. The syphoning action will continue until such time as the solution level 201 reaches lowermost edge 262 of partition segment 270, at which time the column of liquid retained in syphon tube 244 is vented and allowed to discharge into the toilet tank through inlet/discharge port 278.

After the toilet tank water has dropped beneath inlet/discharge discharge port 278, a quantity of product solution 203 remains within solution reservoir 265 at a level approximating that of lowermost edge 262 of partition segment 270. The solution remaining within dispenser 220 serves as a buffer in providing solution for rapid multiple flushes. When the level of toilet tank water rises again, dispenser 220 will once more be restored to the condition illustrated in FIG. 12.

As with the dispensers of FIGS. 1 and 15, the dispenser of FIG. 9 could be equipped with alternative designs for trapping and retaining an air bubble during the water charging operation.

While the exemplary embodiments of dispensers 20, 220, 320, 520 and 620 may be constructed by adhesively securing sections of relatively rigid Plexiglas (Registered Trademark of Rohm & Hass Company) to one another, other relatively rigid materials which are substantially inert with respect to the intended product and aqueous solutions thereof can be used to construct the dispensers. Furthermore, the dispensers may be constructed or formed at high speed and relatively low cost utilizing various manufacturing techniques well known in the art. For example, the dispensers could be vacuum thermoformed in two sections of a material such as polyvinyl chloride having an initial thickness of about 0.02 inches, the solid, water soluble product inserted therebetween and the two sections thereafter secured to one another as by heat sealing, adhesives, etc. along a line of contact substantially coinciding with the location of section line 2—2 of FIG. 1 or section line 10—10 of FIG. 9. Alternatively the full thickness dispenser configuration may be formed in one segment, the water soluble product inserted therein and the land areas of the full thickness segment subsequently secured to a planar segment to form the desired dispenser assembly.

With dispenser embodiments of the present invention, the discharge of product solution is near the end of the flush cycle. The latter feature is highly desirable, since it ensures that more of the product solution dispensed during each flush cycle will be retained in the bowl after the flush cycle has been completed, and thus will be at a higher concentration than if it were dispensed during the early portions of the flush cycle. This is so because of the inherent operation of a flushing toilet. Generally all the water from the toilet tank goes through the toilet bowl. However, the initial portions of water are used to initiate a syphon action in the toilet bowl which carries away the waste material, while the latter portions are used to refill the toilet bowl. By dispensing the product solution into the latter discharged portions of the tank water a higher solution concentration in the toilet bowl is provided intermediate flush cycles. If the product solution were dispensed into the initially discharged portions of the toilet tank water, a large portion of the solution would be carried away with the waste material so that the concentration of solution remaining in the toilet bowl would be greatly reduced.

Dispensers of the present invention are particularly well suited for plural component products which need to be isolated from each other prior to use. Each dispenser section of such a dual or plural product dispenser will maintain a product component in isolation from the toilet tank water and from the other product components disposed in other independent sections. Such plural product dispensing embodiments could be fabricated as a single unit, suspended in the toilet tank independently of one another, or interdependently suspended in the toilet tank by means of a common bracket or the like. Because the constant volume of solution dispensed during each flush cycle may readily be determined, it is thus possible to size such plural product dispensers so that each of the product components will be completely consumed at about the same point in time, thereby minimizing waste of any particular component.

While particular embodiments of the present invention have been illustrated and described, it will be obvious to those skilled in the art that various changes and modifications can be made without departing from the spirit and scope of the invention and it is intended to cover, in the appended claims, all such modifications that are within the scope of this invention. Moreover, while the present invention has been described in the context of dispensing a toilet tank additive, it is not intended to thereby limit the present invention.

What is claimed is:

1. A passive dosing dispenser for containing a quantity of a solution isolated from a body of liquid in which said dispenser is immersed and for causing a predetermined dose-volume of said solution to issue from said dispenser in response to the level of said body of liquid being lowered from a first elevation to a second elevation, said dispenser comprising:

a. an internal reservoir for containing a quantity of said solution;

b. liquid syphoning means in fluid communication with said reservoir for conveying a predetermined dose-volume of said solution from said reservoir into said body of liquid in which said dispenser is immersed in response to the level of said body of liquid being lowered from said first elevation to said second elevation, said syphoning means including passive means for providing a first air-lock in the path of fluid communication between said reservoir and said syphoning means when said dispenser is immersed in said body of liquid; and c. an air vent in fluid communication with said reservoir, said air vent including passive means for providing a second air-lock in the path of fluid communication between said reservoir and said air vent when said dispenser is immersed in said body of liquid to a depth sufficient to block said air vent, whereby said first air-lock and said second air-lock serve to isolate said solution from said body of liquid until such time as said body of liquid is lowered from said first elevation to said second elevation.

2. A passive dosing dispenser comprising an internal reservoir for containing a quantity of a solution isolated by means of air-locks from a body of liquid in which said dispenser is immersed and means for causing a predetermined dose-volume of said solution to be syphoned from said reservoir and issue from said dispenser in response to the level of said body of liquid being lowered from a first elevation to a second elevation, said means comprising an air vent in fluid communication with said reservoir, said air vent including passive means for forming a first air-lock which isolates said solution from said liquid surrounding said dispenser when said air vent is blocked by said liquid, a syphon tubing having an open lower end, an inlet/discharge conduit having a top end in fluid communication with the upper reaches of said syphon tube and a bottom end in fluid communication with said reservoir, and an air trap disposed adjacent said inlet/discharge conduit, said reservoir being in fluid communication exclusively with said inlet/discharge conduit and said air vent, said internal reservoir including a product chamber adapted to hold a quantity of a solid-state product which is solvable in said liquid and for being flooded to a predetermined depth with said liquid to form said solution in said reservoir by dissolving some of said product, said air trap serving to retain an air bubble as said reservoir is being filled by said liquid, said air trap thereafter permitting said air bubble to reposition itself when said liquid ceases to enter said reservoir, thereby forming a second air-lock which isolates said solution from said liquid surrounding said dispenser, said dispenser further comprising means for being so disposed in said body of liquid that said reservoir will be filled with a dose-volume of said liquid when the level of said body of liquid is raised to said first elevation and so that a dose-volume of said solution will be drawn from said reservoir by suction via said inlet/discharge conduit into said syphon tube and thence from said dispenser when the level of said solution in said reservoir is lowered to the bottom end of said inlet/discharge conduit in response to said body of liquid being lowered to said second elevation.

3. The dispenser of claim 2 wherein said air trap is comprised of an expanded cross-sectional flow area followed by a constricted cross-sectional flow area, as measured in a plane substantially perpendicular to the direction of said liquid flow past said air trap.

4. The dispenser of claim 3 wherein said air trap is located laterally adjacent said inlet/discharge conduit.

5. The dispenser of claim 3 wherein said air trap is located adjacent the entrance to said inlet/discharge conduit.

6. The dispenser of claim 3 wherein said air trap is of sufficient volume to fill the top end of said inlet/discharge conduit and the upper reaches of said syphon tube and thereby isolate said solution in said inlet/discharge conduit from said liquid in said syphon tube when said reservoir has been filled.

7. The dispenser of claim 2, wherein said air trap comprises a partial obstruction of said inlet/discharge conduit, whereby liquid passing through said conduit is unable to exert sufficient force on the air bubble retained within said trap to expel said bubble from said conduit as said liquid is being raised from said second elevation to said first elevation.

8. The dispenser of claim 2 wherein said syphon tube is convergent in the direction of liquid flow prevailing within said tube when said liquid is being raised from said second elevation to said first elevation.

9. The dispenser of claim 2 wherein said means for providing said first air-lock in said air vent in fluid communication with said reservoir comprises a pair of vertical passageways in fluid communication with one another only at their uppermost ends to isolate said solution from said liquid surrounding said dispenser.

10. The dispenser of claim 2 including a level control partition in said product chamber in said internal reservoir to permit flooding said internal reservoir to a predetermined depth.

11. The dispenser of claim 2, including means for retaining a predetermined quantity of said solution within said reservoir after said liquid has been lowered from said first elevation to said second elevation.

12. A passive dosing dispenser for containing a quantity of a solution isolated from a body of liquid in which said dispenser is immersed and for causing a predetermined dose-volume of said solution to issue from said dispenser in response to the level of said body of liquid being lowered from a first elevation to a second elevation, said dispenser comprising:

a. an internal reservoir for containing a quantity of said solution;

b. liquid syphoning means in fluid communication with said reservoir for conveying a predetermined dose volume of said solution from said reservoir into said body of liquid in which said dispenser is immersed in response to the level of said body of liquid being lowered from said first elevation to said second elevation, said syphoning means including passive means for providing an air-lock in the path of fluid communication between said reservoir and said syphoning means when said dispenser is immersed in said body of liquid; and c. an air vent in fluid communication with said reservoir, said air vent extending above said first elevation of said body of liquid when said dispenser is immersed in said body of liquid, whereby said air-lock and said air vent serve to isolate said solution from said body of liquid until such time as said body of liquid is lowered from said first elevation to said second elevation.

13. A passive dosing dispenser comprising an internal reservoir for containing a quantity of a solution isolated from a body of liquid in which said dispenser is immersed and means for causing a predetermined dose-volume of said solution to be syphoned from said reservoir and issue from said dispenser in response to the level of said body of liquid being lowered from a first elevation to a second elevation, said means comprising an air vent in fluid communication with said reservoir, a syphon tube having an open lower end, an inlet/discharge conduit having a top end in fluid communication with the upper reaches of said syphon tube and a bottom end in fluid communication with said reservoir, and an air trap disposed adjacent said inlet/discharge conduit, said reservoir being in fluid communication exclusively with said inlet/discharge conduit and said air vent, said internal reservoir including a product chamber adapted to hold a quantity of a solid-state product which is solvable in said liquid and for being flooded to a predetermined depth with said liquid to form said solution in said reservoir by dissolving some of said product, said air trap serving to retain an air bubble as said reservoir is being filled by said liquid, said air trap thereafter permitting said air bubble to reposition itself when said liquid ceases to enter said reservoir, thereby forming an air-lock which isolates said solution from said liquid surrounding said dispenser, said dispenser further comprising means for being so disposed in said body of liquid that said reservoir will be filled with a dose-volume of said liquid without said air vent being blocked by said liquid when the level of said body of liquid is raised to said first elevation and so that a dose-volume of said solution will be drawn from said reservoir by suction via said inlet/discharge conduit into said syphon tube and thence from said dispenser when the level of said solution in said reservoir is lowered to the bottom end of said inlet/discharge conduit in response to said body of liquid being lowered to said second elevation.

14. The dispenser of claim 13 wherein said air trap is comprised of an expanded cross-sectional flow area followed by a constricted cross-sectional flow area, as measured in a plane substantially perpendicular to the direction of said liquid flow past said air trap.

15. The dispenser of claim 14 wherein said air trap is located laterally adjacent said inlet/discharge conduit.

16. The dispenser of claim 14 wherein said air trap is located adjacent the entrance to said inlet/discharge conduit.

17. The dispenser of claim 14 wherein said air trap is of sufficient volume to fill the top end of said inlet/discharge conduit and the upper reaches of said syphon tube and thereby isolate said solution in said inlet/discharge conduit from said liquid in said syphon tube when said reservoir has been filled.

18. The dispenser of claim 13, wherein said air trap comprises a partial obstruction of said inlet/discharge conduit, whereby liquid passing through said conduit is unable to exert sufficient force on the air bubble retained within said trap to expel said bubble from said conduit as said liquid is being raised from said second elevation to said first elevation.

19. The dispenser of claim 13 wherein said syphon tube is convergent in the direction of liquid flow prevailing within said tube when said liquid is being raised from said second elevation to said first elevation.

20. The dispenser of claim 13 including a level control partition in said product chamber in said internal reservoir to permit flooding said reservoir to a predetermined depth.

21. The dispenser of claim 13, including means for retaining a predetermined quantity of said solution within said reservoir after said liquid has been lowered from said first elevation to said second elevation.

* * * * *

UNITED STATES PATENT AND TRADEMARK OFFICE

CERTIFICATE OF CORRECTION

PATENT NO. : 4,208,747

DATED : June 24, 1980

INVENTOR(S) : Robert S. Dirksing

It is certified that error appears in the above-identified patent and that said Letters Patent are hereby corrected as shown below:

Column 3, line 36, "an" should read -- and --.

Column 3, line 51, after "FIG. 2,", insert -- when --.

Column 10, line 18, after "let/discharge", delete "discharge".

Column 10, line 33, "Hass" should read -- Haas --.

Column 12, line 12, "tubing" should read -- tube --.

Signed and Sealed this

*Thirtieth* Day of *September 1980*

[SEAL]

*Attest:*

SIDNEY A. DIAMOND

*Attesting Officer*

*Commissioner of Patents and Trademarks*

REEXAMINATION CERTIFICATE (114th)

United States Patent [19] [11] B1 4,208,747

Dirksing [45] Certificate Issued Aug. 16, 1983

[54] PASSIVE DOSING DISPENSER EMPLOYING TRAPPED AIR BUBBLE TO PROVIDE AIR-LOCK

[75] Inventor: Robert S. Dirksing, Cincinnati, Ohio

[73] Assignee: The Procter & Gamble Company, Cincinnati, Ohio

Reexamination Request:
No. 90/000,266, Oct. 12, 1982

Reexamination Certificate for:

| | |
|---|---|
| Patent No.: | **4,208,747** |
| Issued: | **Jun. 24, 1980** |
| Appl. No.: | **2,524** |
| Filed: | **Jan. 11, 1979** |

Related U.S. Application Data

[63] Continuation-in-part of Ser. No. 897,469, Apr. 18, 1978, abandoned.

[51] Int. Cl.[3] ..... E03D 9/02; E03D 9/03; F04F 10/00; B65D 47/10

[52] U.S. Cl. ..... 4/228; 4/227; 222/416; 222/541

[58] Field of Search ..... 4/227, 228, 231, 226, 4/223, 225; 222/416, 541

[56] References Cited

U.S. PATENT DOCUMENTS

| | | | |
|---|---|---|---|
| 607,818 | 7/1898 | Ashburner | 4/227 |
| 969,729 | 9/1910 | Smith | 4/228 X |
| 1,144,525 | 6/1915 | Blake | 4/228 X |
| 3,009,168 | 11/1961 | Cooper | 4/228 |
| 3,105,245 | 10/1963 | Finkbiner | 4/228 |
| 3,339,801 | 9/1967 | Hronas | 222/57 |
| 3,504,384 | 9/1967 | Radley et al. | 4/228 |
| 3,895,739 | 7/1975 | Buchtel | 222/57 |
| 4,168,550 | 9/1979 | Lindauer | 4/228 |

FOREIGN PATENT DOCUMENTS 19161 9/1892 United Kingdom .

*Primary Examiner*—Henry K. Artis

[57] ABSTRACT

A passive dosing dispenser for issuing, for example, a predetermined volume of a toilet tank additive solution into a toilet tank as the water is draining therefrom while the toilet is flushing. A preferred dispenser comprises a product chamber for containing a quantity of a solid type product which can be dissolved in water to form a toilet tank additive product solution, a reservoir for containing a quantity of said solution in fluid communication with said product chamber, an inlet/discharge conduit having its lowermost end in fluid communication with said reservoir and its uppermost end in fluid communication with a syphon tube, an air trap disposed adjacent said inlet/discharge conduit for isolating said product solution from the toilet tank water in said syphon tube during quiescent periods, and an air vent in fluid communication with said reservoir and product chamber. In operation, while the water in the toilet tank is receding from about the dispenser, a predetermined quantity of said product solution is syphoned from said reservoir through the inlet/discharge conduit and is dispensed through the syphon tube. In a particularly preferred embodiment, the dispenser provides a pair of air-locks when completely immersed in a full toilet tank which air-locks isolate the product and product solution from toilet tank water which surrounds the dispenser during quiescent periods.

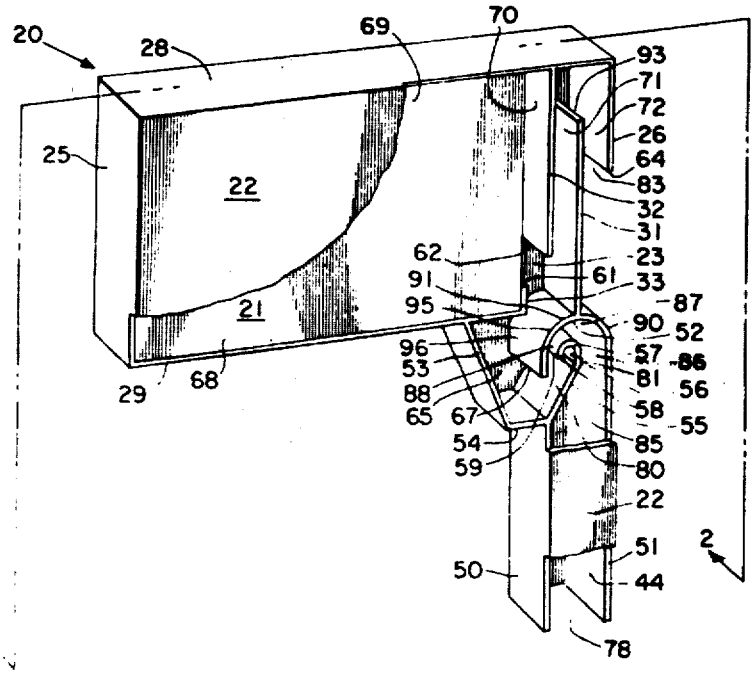

REEXAMINATION CERTIFICATE ISSUED UNDER 35 U.S.C. 307.

PASSIVE DOSING DISPENSER EMPLOYING TRAPPED AIR BUBBLE TO PROVIDE AIR-LOCK

NO AMENDMENTS HAVE BEEN MADE TO THE PATENT.

AS A RESULT OF REEXAMINATION, IT HAS BEEN DETERMINED THAT:

The patentability of claims 1-21 is confirmed.

* * * * *